United States Patent [19]

Chalimbaud

[11] Patent Number: 4,706,743

[45] Date of Patent: Nov. 17, 1987

[54] TUBE PLATES FOR HEAT EXCHANGERS

[75] Inventor: Max Chalimbaud, Plaisir, France

[73] Assignee: Societe Industrielle Pecquet, Tesson, France

[21] Appl. No.: 818,538

[22] Filed: Jan. 13, 1986

[51] Int. Cl.[4] ..... F28F 19/00

[52] U.S. Cl. ..... 165/134.1; 165/158

[58] Field of Search ..... 165/134.1, 174, 158

[56] References Cited

U.S. PATENT DOCUMENTS

| | | | |
|---|---|---|---|
| 307,480 | 11/1884 | Luttgen | 165/174 X |
| 1,184,199 | 5/1916 | Morison | 165/174 |
| 1,978,166 | 10/1934 | Meurk | 165/134.1 |
| 2,897,252 | 7/1959 | Martin | 165/134.1 |
| 3,374,832 | 3/1968 | Tucker | 165/134.1 |

FOREIGN PATENT DOCUMENTS

| | | | |
|---|---|---|---|
| 962437 | 4/1957 | Fed. Rep. of Germany | 165/134 R |
| 1046053 | 7/1953 | France | 165/134 R |
| 2350567 | 2/1977 | France | 165/134 R |
| 65895 | 5/1980 | Japan | 165/134 R |
| 1344812 | 1/1974 | United Kingdom | 165/134 R |
| 817396 | 3/1981 | U.S.S.R. | 165/134 R |

*Primary Examiner*—Albert W. Davis, Jr.
*Assistant Examiner*—Peggy Neils
*Attorney, Agent, or Firm*—Jacobs & Jacobs

[57] ABSTRACT

A heat exchanger tube plate is provided having tubular pieces for protecting its face or the ends of its tubes, of the type each comprising a cylindrical sleeve with bent back circular edge, or head, forming a collar and positioned inside the end of said tubes or bores. According to the invention, the head of said protecting pieces has for external contour a polygon whose sides, parallel in pairs, are perpendicular to the planes joining the axes of the tube, or bore, of the tube plate to which they are applied to the axes of the adjacent tubes or bores, the distance between the parallel sides being greater than that separating the adjacent axes situated in the plane to which the sides are perpendicular, and one of the sides having an offset flange, namely a flange offset with respect to the plane of the head by a height substantially equal to the thickness of this head.

7 Claims, 14 Drawing Figures

TUBE PLATES FOR HEAT EXCHANGERS

BACKGROUND OF THE INVENTION

The present invention relates to temperature exchangers which comprise tube plates, namely plates pierced with simple bores or having tubes passing therethrough which open at the surface thereof.

For protecting the faces of such plates or the ends of such tubes against corrosion, erosion and/or temperature phenomena, it is current practice to use pieces called "ferrules" in the form of tubes with turned down circular edge, forming a collar, which are positioned inside the end of the tubes or bores of the tube plate.

So that these "ferrules" may provide maximum protection, their collars must overlap in successive stacks going up to four thicknesses.

This means of protection has numerous disadvantages, more particularly the surface roughness, gaps between the different collar levels and the impossibility of sealing the face formed by the assembly of collars.

SUMMARY OF THE INVENTION

The invention aims at overcoming these drawbacks and, for this, proposes substituting for the circular head of conventional tubular pieces, a head having for external contour a polygon whose sides, parallel in pairs, are perpendicular to the planes joining the axis of a tube, or bore, of the tube plate, to which they are applied to the axis of adjacent tubes or bores, the distance between the parallel sides being greater than that separating the adjacent axes situated in the plane to which these sides are perpendicular, and one of these sides having an offset flange i.e. a flange offset with respect to the plane of the head, of a height substantially equal to the thickness of this head.

The form of the head according to the invention depends on the distribution or pitch of the tubular elements of the plates. It will be hexagonal for a triangular or diamond shaped distribution; it will be square for a square distribution; it may be pentagonal at the end edge of the tube plate.

With the structure of the head of the protecting pieces in accordance with the invention, it becomes possible to obtain complete coverage of the surface of the tube plate, by forming a surface whose roughnesses are limited by a single additional thickness, and which may be perfectly protected, possibly with the flow of a fluid between the face of a tube plate and the new face created.

The parts of the invention further allow the same conditions of protection to be obtained as with known parts, namely:

coverage over a variable length of the inner surface of the tubes or bores, coverage of the end of the tube of of the edge of the bore, the use of suitable materials, possibly different from those of the tube plates and/or of the tubes of the stack, chosen as a function of the service conditions, the acceptance of differential expansions when using different materials, if that is required, the neutralization of manufacturihg tolerances, or the adaptability to flat, shaped or cylindrical (manifold) tube plates.

Coverage of the tube plate by parts with a hexagonal held may be provided using parts whose held only comprises a single offset flange but with this latter reversed from one row to the next so that no gap exists between the heads so requiring two types of parts.

For covering using square head parts, it is provided with heads comprising an offset flange over two adjacent sides, but only requiring a single type of part.

Since the parts or pieces of the invention allow a perfectly sealed space to be obtained between the tube plate and the new face created, it is advisable to provide sealing between the sleeves of the protecting pieces and the tubes of the exchanger. For this, the invention provides sealing at the contact of the end of the sleeve with the tube, either by welding, or by expansion with or without bonding, the edge of the sleeve being thinned down or not.

BRIEF DESCRIPTION FO THE DRAWINGS

By way of simple illustration, embodiments of the protection pieces of the invention have been: shown in the accompanying drawings in which.

Figure 8:
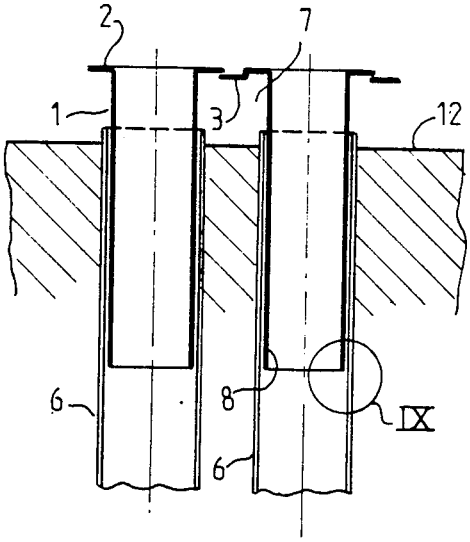
FIG. 8 is a sectional view of a tube plate zone having two protecting pieces in accordance with the invention.
Figure 10:
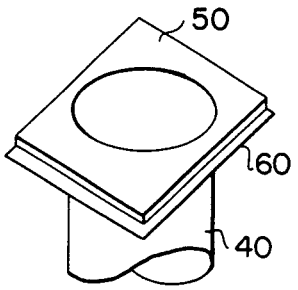
Figure 11:
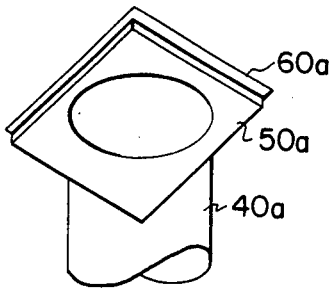
Figure 12:
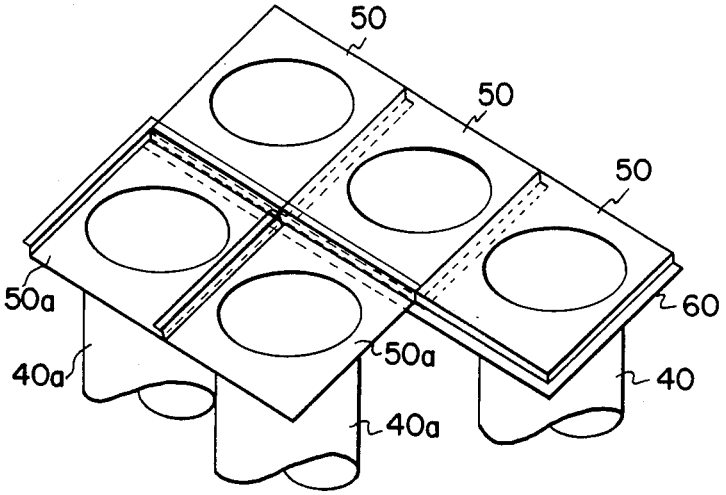

FIGS. *9a*, *9b* and *9c* are detailed views on a larger scale of the end zone IX of the sleeves of FIG. 8;

FIG. 10 is a perspective view of a piece with a square head;

FIG. 11 is a perspective view of a piece identical to that of FIG. 10, but with reverse flanges; and FIG. 12 is a top view of a tube plate coverage face position.

DESCRIPTION OF THE PREFERRED EMBODIMENTS

Figure 1:
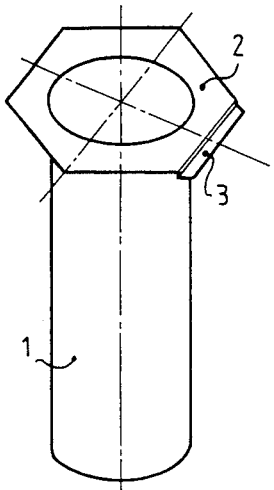
FIG. 1 is a perspective view of a piece with hexagonal head.
Figure 2:
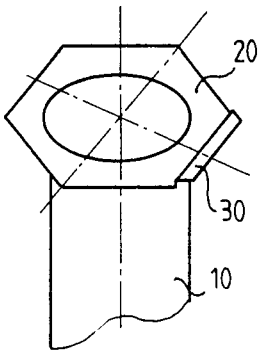
FIG. 2 is a perspective view of a piece identical to that of FIG. 1, but with reverse offset flange.
Figure 3:
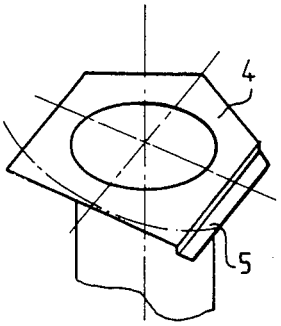
FIG. 3 is a perspective view of a piece with pentagonal head.

In the example shown in the drawings, the protecting pieces have the shapes shown in FIGS. 1, 2 and 3. The piece of FIG. 1 comprises a cylindrical sleeve 1 and a hexagonal head 2 one of the sides of which is deformed so as to have a flange 3 offset axially with respect to the plane of the head 2, of a height slightly greater than the thickness of the head. The piece shown in FIG. 2 is identical to that shown in FIG. 1, but the flange 3o of its head 20 is offset in the opposite direction to flange 3. The piece shown in FIG. 3, whose sleeve is identical to sleeves 1 and 10 of the other two types, has a pentagonal head 4 one of the sides of which has a flange 5 offset in height by the thickness of its head.

Figure 4:
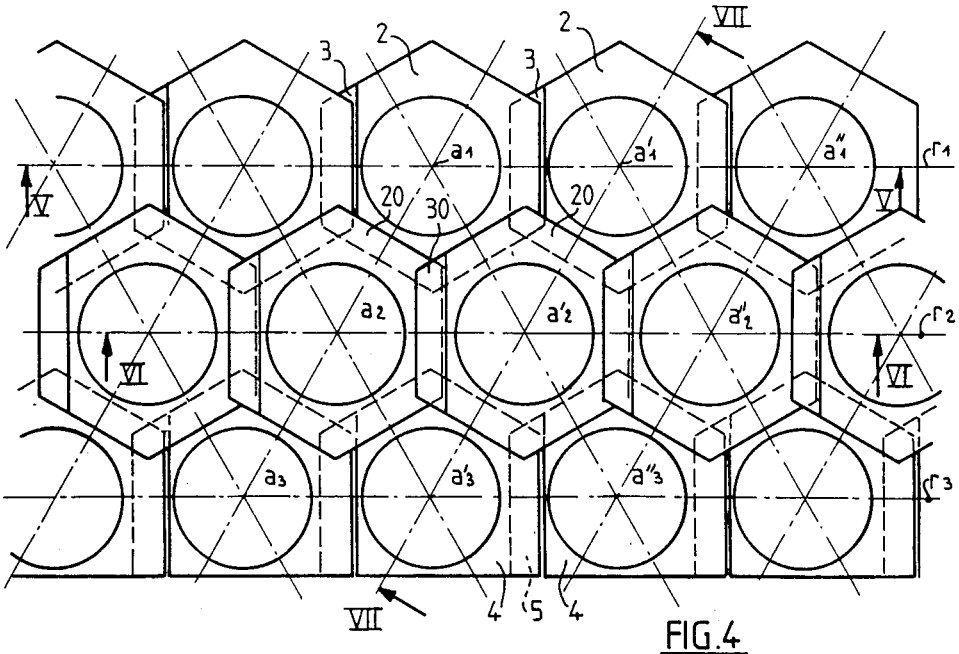
FIG. 4 is a top view of a tube plate coverage face position.

In the example shown in FIG. 4, the tubes, or bores, of the tube plate have a triangular distribution. that is to say that the axes $a_1$, $a'_1$, $a''_1$. . . of a row $r_1$ are offset by a half pitch (half the between axis distance) with respect to the axes $a_2$, $a'_2$, $a''_2$. . . of the next parallel row $r_2$.

The protecting pieces of row $r_1$ are of the type shown in FIG. 1 with flange 3 offset downwards with respect to head 2, whereas the pieces of row $r_2$ are of the type shown in FIG. 2 with flange 30 offset upwardly with respect to head 20 and the pieces of row $r_3$ (corresponding to the edge of the tube plate) are of the type shown in FIG. 3 with flange 5 offset downwardly with respect to head 4.

With the structure of the pieces of the invention, coverage of the tube plate is provided by means of a practically flat surface, in which the extra thicknesses are limited to a head thickness from one row to another, and practically without any gap between the protecting pieces.

Figure 5:
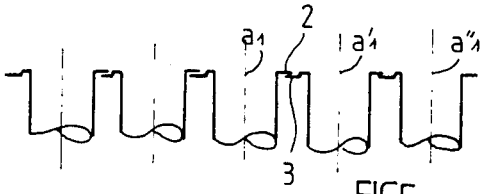
FIG. 5 is a sectional view, on a reduced scale, through the line V—V of FIG. 4.
Figure 7:
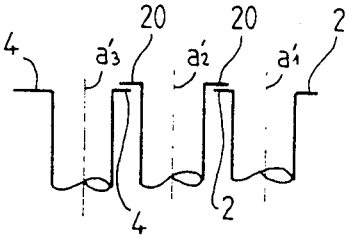
FIG. 7 is the sectional view on a reduced scale through the line VII—VII of FIG. 4.
Figure 6:
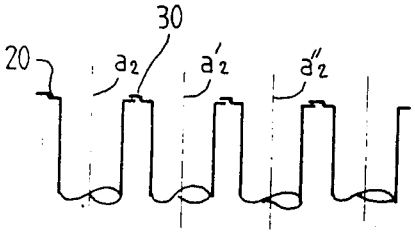
FIG. 6 is a sectional view on a reduced scale through the line VI—VI of FIG. 4.

As can be clearly seen in the FIGS. 5 to 7.

This structure therefore allows this created surface to be perfectly sealed, for example by welding.

The protecting pieces may obviously be introduced to a greater or lesser depth in the tubes 6 (or bores) of the the plate and so, as can be seen in FIG. 8, allows a given volume to be reserved in space 7 between the face 12 of the tube plate and the surface created by the assembly of heads 2. This volume may be perfectly sealed, for example by welding, brazing or bonding of the flanges 3 and adjacent heads 2 and by adequate connection of the lower end 8 of sleeves 1 against the inner wall of tubes 6.

Figure 9A:
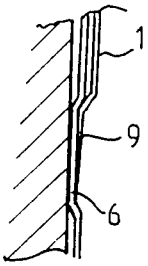
Figure 9B:
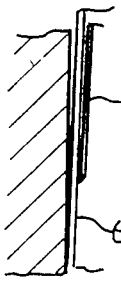
Figure 9C:
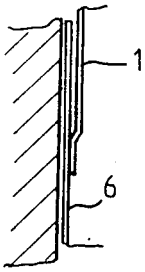

This connection may be provided, as shown in FIG. 9*a*, by expanding the thinned down edge 9 of sleeve 1, for example by expansion or by simple welding (FIG. 9) or else slight expansion without thinning (FIG. 9*c*) with or without bonding.

What is claimed is:

1. In a tube plate for a heat exchanger having tubular pieces for protecting its face or the ends of its tubes, comprising a cylindrical sleeve with a bent back circular edge, or head, forming a collar, and positioned inside the end of said tubes or bores, the head of said protecting pieces has for an external contour a polygon whose sides, parallel in pairs, are perpendicular to the planes joining the axis of a tube, or bore, of the tube plate to which they are applied to the axes of the adjacent tubes or bores, the distance between the parallel sides being greater than that separating the adjacent axes situated in the plane to which these sides are perpendicular, and one of the sides having an offset flange, namely a a flange offset with respect to the plane of the head by a height substantially equal to the thickness of said head.

2. The tube plate as claimed in claim 1, with triangular distribution (pitch) of the tubular elements, wherein the head of the standard protection pieces is hexagonal.

3. The tube plate as claimed in claim 2, wherein the hexagonal head comprises only one offset flange, but it is inverted from one row to the next so that no gap exists between the heads.

4. The tube plate as claimed in claim 1, with square distribution of the tubular elements, wherein the head of the protecting pieces is square and comprises an offset flange on two adjacent sides.

5. The tube plate as claimed in claim 1, wherein sealing means are provided in contact with the end edge of the sleeve of the protecting pieces and with the inner surface of the tubes of the exchanger.

6. A protecting piece for a tube plate such as claimed in claim 1, comprising a hexagonal head one of the sides of which has a flange offset, with respect to the plane of the head, by a height substantially equal to the thickness of said head.

7. The protecting piece for a tube plate as claimed in claim 1, comprising a square head two adjacent sides of which have a flange offset, with respect to the plane of the head, by a height substantially equal to the thickness of said head.

* * * * *